US006103182A

United States Patent [19]

Campbell

[11] Patent Number: 6,103,182

[45] Date of Patent: Aug. 15, 2000

[54] DISPENSING APPARATUS AND METHOD

[75] Inventor: John Campbell, West Malvern, United Kingdom

[73] Assignee: Alotech, Inc., Cleveland, Ohio

[21] Appl. No.: 09/339,134

[22] Filed: Jun. 24, 1999

[30] Foreign Application Priority Data

Jun. 27, 1998 [GB] United Kingdom ..... 9813826

[51] Int. Cl.[7] ..... C21B 7/12

[52] U.S. Cl. ..... 266/45; 266/239; 222/590; 222/595

[58] Field of Search ..... 266/239, 45; 222/595, 222/590; 164/113, 337

[56] References Cited

U.S. PATENT DOCUMENTS 3,050,794 8/1962 Holz ..... 266/239
3,652,073 3/1972 Lewis ..... 266/239
5,657,812 8/1997 Walter et al. ..... 164/113
5,700,422 12/1997 Usui et al. ..... 266/239

*Primary Examiner*—Scott Kastler
*Attorney, Agent, or Firm*—Fay, Sharpe, Fagan, Minnich & McKee, LLP

[57] ABSTRACT

Apparatus for dispensing a liquid material from a reservoir (12), the apparatus comprising a first vessel (11) which forms an intermediate chamber and which is arranged to receive material from the reservoir (12), a second vessel (10) which forms a dispensing chamber and which is arranged to receive material from the intermediate chamber (11), first pressurizing means whereby the intermediate chamber (11) can be pressurized, second pressuring means whereby the dispensing chamber (10) can be pressurized, first valve means (13) operable to permit material to be admitted into the intermediate chamber (11) from the reservoir (12), second valve means (14) operable to permit material to be admitted into the dispensing chamber (10) from the intermediate chamber (11) and a duct (19) extending from within the dispensing chamber (10) whereby material can be dispensed through the duct (19) from the dispensing chamber (10) by pressurization of the dispensing chamber (10)

15 Claims, 3 Drawing Sheets

DISPENSING APPARATUS AND METHOD

This invention relates to a dispensing apparatus for dispensing a liquid metal and to a method of dispensing a liquid metal into a mould by means of such an apparatus.

The transfer of liquid metal, in particular liquid aluminium, into moulds to make castings is usually carried out by simply pouring under gravity. There are a number of severe disadvantages to this technique, in particular, the entrainment of air and oxides as the metal falls in a relatively uncontrolled way.

To overcome the worst features of this method of mould filling, the so-called Low Pressure (LP) Casting Process was developed. In this technique the metal is held in a large bath or crucible, usually of at least 200 kg capacity of liquid metal, which is contained within a pressurisable enclosure known as a pressure vessel. The pressurisation of this vessel with a low pressure (typically a small fraction such as 0.1 to 0.3 atmosphere) of air or other gas forces the liquid up a riser tube and into the mould cavity which is mounted above the pressure vessel.

The LP Casting Process suffers from the refilling of the internal crucible or bath. The metal has to be introduced into the vessel via a small door, through which a kind of funnel is inserted to guide the liquid metal from a refilling ladle through the door opening and into the pressure vessel. The fall into the funnel, the turbulent flow through the funnel and the final fall into the residual melt all re-introduce to the liquid metal air and oxides, the very contaminants which the process seeks to avoid. Additional problems of control of the filling of the mould occur because the large size of the casting unit involves two additive penalties: (i) the large volume of gas above the melt is of course highly compressible, and thus gives rather "soft" or "spongy" control over the rate of filling; in addition, (ii) the problem is compounded because of the large mass of metal in the furnace which needs to be accelerated by the application of the gas pressure. The problem is akin to attempting to accelerate (and subsequently decelerate) a battering ram weighing 200 kg or more by pulling on a few weak elastic bands.

The so-called Cosworth Process was designed to avoid this problem by the provision of melting and holding furnaces for the liquid aluminium which were joined at a common level, so that the metal flowed from one to the other in a tranquil manner. The liquid is finally transferred into the mould cavity by uphill transfer, using an electromagnetic (EM) pump which is permanently immersed in the melt, and which takes its metal from beneath the liquid surface, and moves it up a riser tube into the mould cavity without moving parts.

The control over the rate of flow of the metal is improved because the working volume in the pump and its delivery pipe is only a few kg. However, the driving force is merely the linkage of lines of magnetic flux, resembling the elastic bands in the mechanical analogy, so that control is not as precise as might first be thought.

Although there are many advantages to the Cosworth solution, the EM pump is not without its problems:

(i) It is expensive in capital and running costs. The high maintenance costs mainly arise as a result of the special castable grade of refractory for the submerged sections of the pump. These require regular replacement by a skilled person. In addition, they are subject to occasional catastrophic failure giving the various types of EM pumps a poor reputation for reliability. The disappointing trustworthiness is compounded by their extreme complexity and delicacy.

(ii) The relatively narrow passageways in the pump are prone to blockage. This can occur gradually by accretion, or suddenly by a single piece of foreign material.

(iii) Occasional voltage fluctuations cause troublesome overflows when the system is operating with the metal at the standby (sometimes called the bias) level.

(iv) At low metallostatic heads, the application of full power to the pump to accelerate the metal as quickly as possible sometimes results in a constriction of flow inside the pump as a result of the electrical pinch effect at high current density. If the pinch completely interrupts the channel of liquid metal current arcing will occur, causing damage, and temporarily stalling the flow. The pump has difficulty to recover from the condition during that particular casting, with the consequence that the casting is filled at too low a speed, and is thus defective.

A number of attempts have been made to emulate the Cosworth Process using pneumatic dosing devices which are certainly capable of raising the liquid into the mould cavity. However, in general these attempts are impaired by the problem of turbulence during the filling of the pressurisable vessel, and by the large volume of the apparatus, thus suffering the twin problems of large mass to be accelerated and large compressible gas volume to effect this action.

One of the first inventions to answer these criticisms effectively is described in British Patent 1 171 295 applied for Nov. 25, 1965 by Reynolds and Coldrick. That invention provides a small pressure vessel which is lowered into a source of liquid metal. An opening at its base allows metal to enter. When levels inside and out are practically equalised the base opening is closed. The small internal gas space above the enclosed liquid metal is now pressurised, forcing the metal up a riser tube and into the mould cavity. After the casting has solidified, the pressure in the pump can be allowed to fall back to atmospheric, allowing the metal to drain back down the riser tube. The base opening can be re-opened to refill the vessel, which is then ready for the next casting. The compact pneumatic pump has been proven to work well in service. The only major problem in service when pumping liquid aluminium has been found to be the creation of oxides in the riser tube. These are created each time the melt rises and falls. Thus the riser tube may not only become blocked, but oxides which break free are carried into the casting and impair its quality, possibly resulting in the scrapping of the casting.

The object of the present invention is to combine the advantages of the EM pump with the simplicity of a pneumatic delivery system, without the disadvantages of either, thereby providing a compact pneumatic pump which has the capability to retain the liquid metal at a high level, just below the top of the riser tube, at all times during the sequential production of castings, thus minimising the creation of oxides.

The invention provides, in a first aspect, apparatus for dispensing a liquid material from a reservoir of said liquid material, the apparatus comprising a first vessel which forms an intermediate chamber and which is arranged to receive material from the reservoir, a second vessel which forms a dispensing chamber and which is arranged to receive material from the intermediate chamber, first pressurising means whereby the intermediate chamber can be pressurised, second pressurising means whereby the dispensing chamber can be pressurised, first valve means operable to permit material to be admitted into the intermediate chamber from the reservoir, second valve means operable to permit material to be admitted into the dispensing chamber from the intermediate chamber, and means forming a duct extending from within the dispensing chamber whereby material can be dispensed through the duct from the dispensing chamber by pressurisation of the dispensing chamber.

Such apparatus may be used in dispensing molten metal, for example aluminium or magnesium, into moulds for manufacturing castings.

For apparatus suitable for dispensing liquid aluminium, the main vessels, stopper rods and riser tube can all be bought at modest cost from existing suppliers of crucibles, thermocouples and tubes, in commonly available materials such as clay/graphite or clay/SiC refractories. Also, such materials are designed to be especially damage-tolerant at temperature, becoming tough as their glassy phase bond partially softens. At operating temperature, such materials are designed to deform, rather than to fail in a brittle manner.

For apparatus suitable for dispensing liquid magnesium, the main vessels, stopper rods and riser tube can all be fabricated from iron, mild steel or ferrite stainless steel. Thus, the materials and the fabrications cost are again low and the material is resistant to brittle failure at temperature, so that the device itself is robust. The pressurising gas can be dry air or dry carbon dioxide, both cheap gases, but rendered inert by the admixture of up to about 2 percent by volume of sulphur hexafluoride (or other more environmentally—benign gas).

For dispensing higher-temperature liquid metals, the materials of the apparatus will become progressively more expensive. Such materials as SiC, SiN and SiAlONs (ceramics based on silicon/aluminium oxy-nitride) and possibly various oxide based ceramics may become necessary. A truly inert pressurising gas such as Argon will also be required for such service.

The invention provides, in a second aspect, a method of dispensing molten metal into moulds, by means of apparatus according to the first aspect, the method comprising a repeated cycle of operations comprising:

(i) pressurising a dispensing chamber containing molten metal to cause metal to be discharged through a riser duct from the chamber into a mould;

(ii) reducing pressure in the dispensing chamber in order to lower the level of the metal in the riser duct to a stand-by level;

(iii) pressurising an intermediate chamber containing molten metal in order to transfer metal from the intermediate chamber into the dispensing chamber to re-charge the dispensing chamber whilst maintaining the level of metal in the riser duct at or about the stand-by level; and (iv) re-charging the intermediate chamber from a reservoir of molten metal, flow passageways between the intermediate chamber and the dispensing chamber and between the reservoir and the intermediate chamber being opened as required to permit metal to be transferred into the chambers.

BRIEF DESCRIPTION OF THE DRAWINGS

The present invention will be illustrated, merely by way of example, in the following description and with reference to the accompanying drawings.

In the drawings, (wherein like numerals denote like parts).

Figure 1:
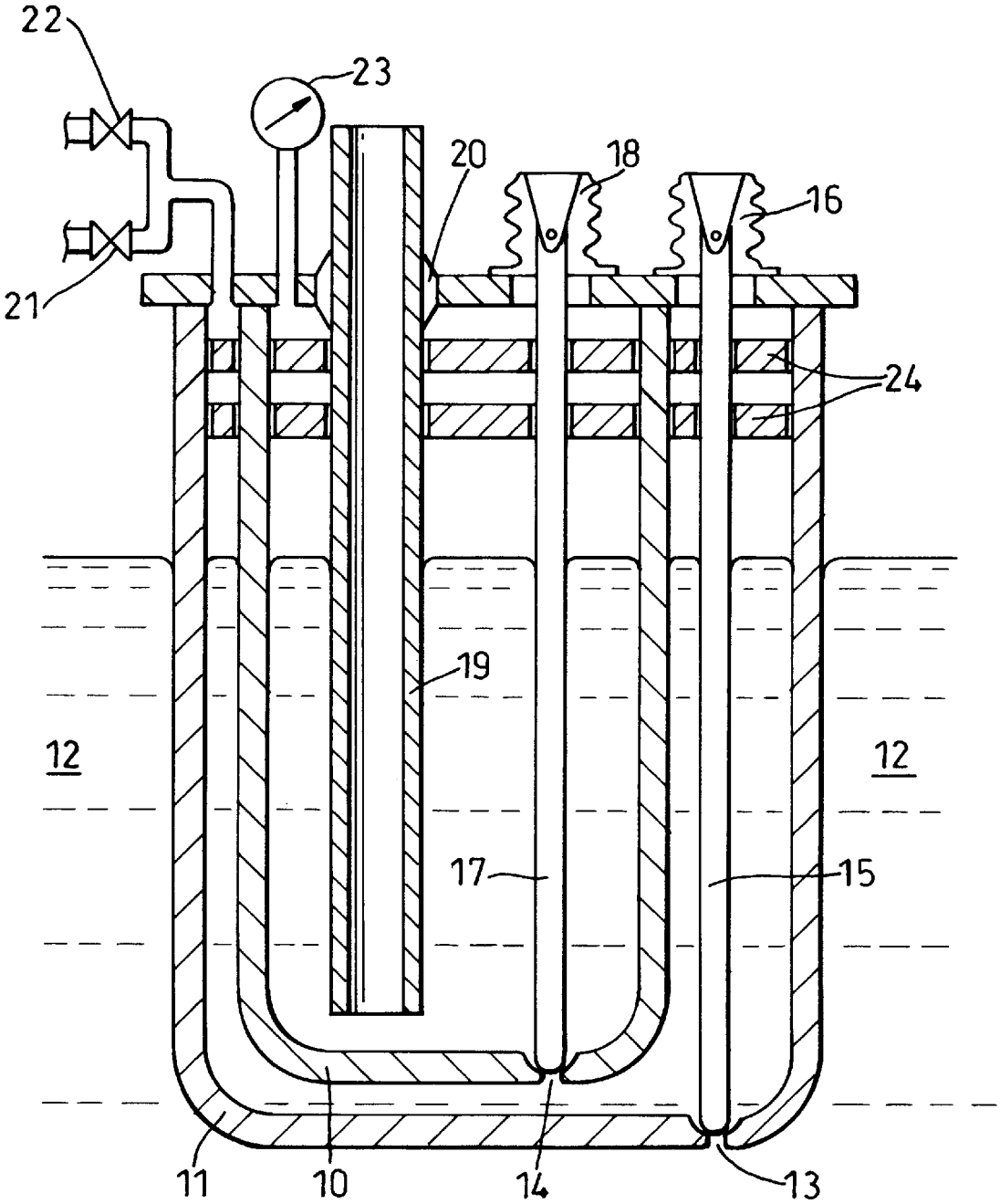
FIG. 1 is a longitudinal section through an apparatus according to the first aspect of the present invention.

The apparatus shown in FIGS. 1 and 2A to 2E acts in the manner of a liquid metal pump and will hereinafter be referred to as such.

The pump comprises a dispensing chamber 10 which is surrounded by and adapted to receive liquid metal from an intermediate chamber 11. The intermediate chamber 11 is immersed in and adapted to receive liquid metal from a reservoir 12 of liquid metal.

Reception of liquid metal from the reservoir 12 to the intermediate chamber 11 and from the intermediate chamber 11 to the dispensing chamber 10 takes place through valves 13 and 14 respectively. Valve 13 is closable by means of a stopper-rod 15, which is in turn operatively associated with a bellows 16 to permit vertical movement of the rod and a gas-tight seal relative to the pump.

Similarly, valve 14 is closable by means of a stopper-rod 17 operatively associated with a bellows 18. A riser tube 19 extends from the dispensing chamber 10 to a mould 30. The riser tube is sealed relative to the chamber by means of a gas-tight seal 20 (which may be, for example, a heat-insulating, ceramic-fibre-packed gland).

The pressure in the two chambers is changed as required by the application of a vacuum through valve 21 and/or the admission of a pressurising gas through valve 22. The pressure is indicated by means of a pressure-gauge shown schematically at 23.

A pair of heat-shields 24 minimises beat-loss from the two chambers 10 and 11.

When the pump is lowered into the reservoir 12 of molten metal, the liquid metal enters both the chambers 10 and 11 via valves 13 and 14, equalising all metal levels providing the gas in the chambers can vent to atmosphere via the vent 21 and up the riser tube 19.

The closing of valve 13 and the introduction of pressurised gas via the valve 22 pressurises both chambers, with the result that metal is forced up the riser tube 19 and into a mould 30 to make a casting 31. The casting pressure and resultant over-pressure are indicated by arrow XX' in FIG. 2B. (As shown in FIG. 2B, the level in chamber 10 is raised almost imperceptibly as a result of the compression of the gas volume).

Figures 2A, 2B, 2C, 2D, 2E:
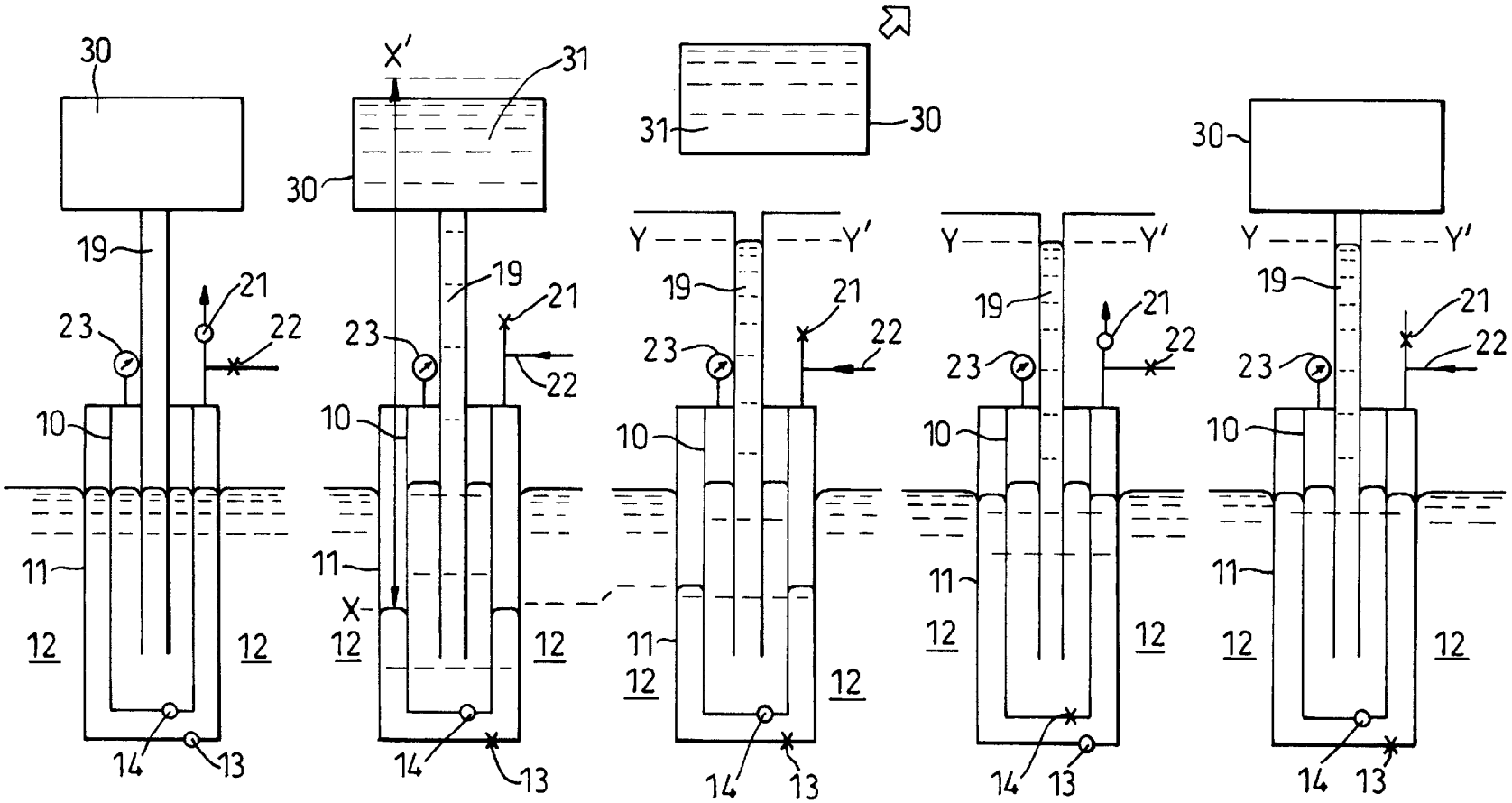
FIGS. 2A, 2B, 2C, 2D and 2E, in sequence, show schematically a process according to the second aspect of the present invention, using the apparatus of FIG. 1.

Once the casting 31 has solidified, the gas pressure at 22 can be allowed to fall, causing the metal level to be lowered to the stand-by level indicated by broken lines YY' in FIGS. 2C, 2D and 2E.

The precise amount of fall is monitored by the pressure gauge 23, since the relative constancy of the height of the liquid in the inner chamber means that any pressure head monitored by 23 will correspond to a precise height in the riser tube 19.

The valve 14 is closed, sealing and isolating the chamber 10 so that the stand-by level YY' is maintained. This level is only approximately 50 mm below the top of the metal delivery point at the mould 30. Valve 13 is now opened, and vent 21 opened to allow the depressurisation of the chamber 11, which can now be allowed to refill. This refilling phase can of course be simply speeded up by closing vent 21, and applying a modest partial vacuum at 22. In this way the cycle time of the pump can be greatly increased. In addition, the technique of using the vacuum to aid the filling of the pump can be useful if the general liquid level in the reservoir 12 falls low. The maintenance of the standard level in the chamber 11 (by means of suitable probes or sensors) allows the pump to continue functioning without changes to other pressure settings, and thus allows the pump to function repeatably despite metal level changes in the reservoir 12.

When the chamber 11 is refilled (FIG. 2E) valve 13 can be closed and valve 14 opened. The pump is now ready to repeat its cycle once a new mould 30 is placed in position on the casting station.

Safety interlock means, known per se, prevent the operation of the pump without the mould being in position and properly clamped. Other safety features such as an electrode surrounding the mould platform on the casting station can detect the escape of liquid metal if a mould leaks, and can automatically stop the casting cycle.

The pressure in the chamber 11 is then raised to that in the chamber 10 and the valve 14 then opened. Continuing transfer of gas into the chamber 11 will then displace liquid metal, refilling the chamber 10. Simultaneous exhausting of gas from the chamber 10 will be needed during this time to maintain a constant pressure above the melt and thus maintain constant the level of the liquid at the top of the riser tube 19. The operating sequence is shown in FIG. 2 as A-BCDE-BCDE-BCDE etc.

Figure 3:
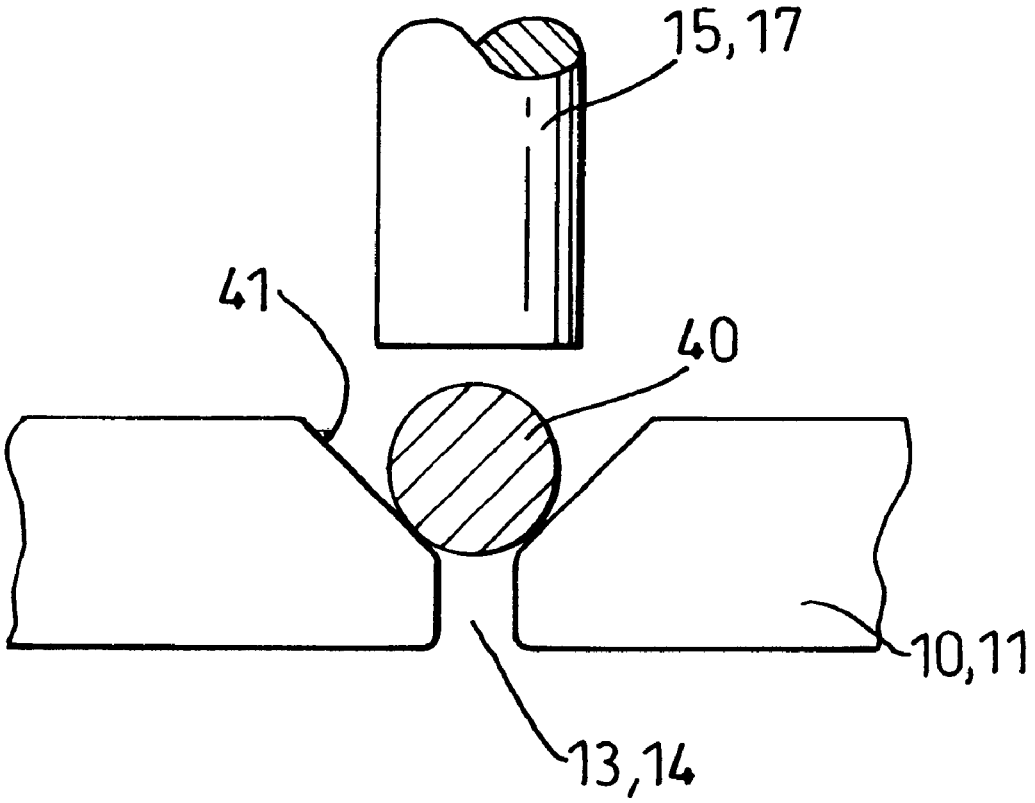
FIG. 3 is a preferred form of a valve for use in the apparatus of FIG. 1.

The valves 13 and 14 can be constructed in a variety of ways. Automatic, or passive, closing can be effected by the use of a ball 40 of a refractory material of density higher than that of the liquid metal, which is located in a countersunk, conical seating 41 forming the entrance of the valves 13/14 (as shown in FIG. 3). However, such devices are subject to leakage if a piece of debris prevents the proper seating of the ball. An active closing mechanism is favoured in which the openings are closed by means of a stopper rod 15/17. The closure force can be adjusted to reduce the incidence of leaks, and a partial rotation of the rod after closing can be employed to assist the effectiveness of the closure. The further advantage of the active sealing is that the pump can be drained quickly if necessary.

The advantages of the pump are many:

1. Compact size and extreme simplicity, giving a low capital outlay.
2. Reduced demand for gas, allowing inert gas to be used economically. This enhances casting quality whilst extending pump life.
3. Reduced gas volume gives improved potential for precision control over flow and pressure.
4. Pressure is under direct control via pressure gauges and pressure switches etc. (and not indirectly via voltage or current, and an implied voltage/pressure/flow characteristic for instance, which is in any case rather variable from time to time).
5. The delivery rate capability of the pump is high for any metal system because of wide feed tubes. This contrasts with EM pumps which have limited performance on aluminium, and are somewhat less developed for magnesium, and, so far, not capable at all for heavier liquid metals.
6. The design is not susceptible to blockage.
7. The pump can sit in an open furnace, allowing the melt to be treated immediately prior to being cast (in most LP systems the melt is enclosed in a pressure vessel and thus inaccessible).
8. It can maintain the melt at the stand-by level, thus reducing oxide contamination of the melt, and reducing the delay of the melt arrival time when required for the next casting.
9. The maintenance of the melt at the stand-by level is perfectly steady and safe whilst valve 14 remains closed. This contrasts with the operation of EM pumps where software faults or mains voltage fluctuations cause the Melt to overflow unpredictably from the casting station. This is a serious threat to the safety of operating personnel.
10. The recharging of the pump is from beneath the surface of the melt, involving no surface turbulence and thus no degradation of metal quality.
11. The recharging can be effected within the cycle time with the aid of vacuum-assisted filling if necessary (most LP systems require an interruption to casting while the pressure vessel is charged).
12. Recharging can be accomplished to the same internal height inside the pump, using vacuum-assisted filling. Thus the pump can be operated in a mode which is completely insensitive to wide level fluctuations in the furnace bath (this contrasts with the behaviour of EM pumps which are especially sensitive to changes outside of narrow restricted limits).
13. Mechanical failure of the pump is not expected to be associated with any danger to personnel or equipment. In fact the unit has intrinsic safety features. This is because
    a. Even for a pump capable of delivery of large volumes of liquid metal, the unit can be built well below the limit of 250 bar.litres, this is the energy level at which a vessel is regarded by law as constituting a pressure vessel. Below this limit the contained energy is considered too low to be of any significant danger.
    b. If the pump becomes accidentally over-pressurised, which might lead to a possible dangerous condition, the assembly is simply arranged for the lid to raise against specially calibrated spring pressure, thus harmlessly dissipating the excess pressure. Alternatively, a bursting disc can be provided. Such an escape of gas necessarily occurs above the level of the liquid metal and thus is safe. This is in contrast to a LP unit. Failure of a crucible in a LP furnace can endanger the interior of the furnace and destroy the heating elements. Failure of the pressure vessel itself could be much more serious. The possibility of the accidental opening of the charging door while the furnace is under pressure is a reason why some LP operators will not use the facility provided to maintain the liquid level at a stand-by height.

What is claimed is:

1. Apparatus for dispensing a liquid material from a reservoir of said liquid material, said apparatus comprising a liquid material to be dispensed, a first vessel which acts as an intermediate chamber configured to receive said liquid material from said reservoir, a second vessel which acts as a dispensing chamber configured to receive said liquid material from said intermediate chamber, a first pressurizing means, comprising inert gas, for pressurizing said intermediate chamber, a second pressurizing means, comprising inert gas, for pressurizing said dispensing chamber, a first valve configured to permit said liquid material to be admitted into said intermediate chamber from said reservoir, a second valve configured to permit said liquid material to be admitted into said dispensing chamber from said intermediate chamber, and a duct extending from within said dispensing chamber and configured to dispense said liquid material through said duct from said dispensing chamber by pressurization of said dispensing chamber.

2. The apparatus of claim 1, wherein said liquid material consists essentially of a molten metal to be dispensed through said duct into a mould.

3. The apparatus of claim 2, wherein said molten metal is aluminium.

4. The apparatus of claim 2, wherein said molten metal is magnesium.

5. The apparatus of claim 3, wherein at least said first and said second vessels are made from a refractory material selected from the group consisting of clay/graphite refractory materials and clay/silicon carbide refractory materials.

6. The apparatus of claim 4, wherein at least said first and said second vessels are made from a material selected from the group consisting of iron, mild steel and ferrite stainless steel.

7. The apparatus of claim 1, wherein said inert gas is selected from the group consisting of air and carbon dioxide.

8. The apparatus of claim 7, wherein said inert gas is admixed with up to about 2% by volume of sulphur hexafluoride.

9. A method of dispensing molten metal into a mould by means of the apparatus of claim 2, wherein said method comprises a repeated cycle of operations comprising:

(i) pressurizing said dispensing chamber containing said molten metal to cause said molten metal to be discharged through said duct from said dispensing chamber and into said mould;

(ii) reducing pressure in said dispensing chamber to lower the level of said molten metal in said duct to a stand-by level;

(iii) pressurizing said intermediate chamber containing said molten metal to transfer said molten metal from said intermediate chamber into said dispensing chamber, thereby recharging said dispensing chamber while maintaining the level of said molten metal in said duct at or about said stand-by level; and (iv) re-charging said intermediate chamber from said reservoir of molten metal, said second valve between said intermediate chamber and said dispensing chamber and said first valve between said reservoir and said intermediate chamber being selectively opened and closed as required to permit said molten metal to be transferred into and out of said chambers.

10. Apparatus for dispensing a liquid material from a reservoir of said liquid material, said apparatus comprising an intermediate chamber configured to receive said liquid material from said reservoir, a dispensing chamber configured to receive said liquid material from said intermediate chamber, a first pressurizing means, comprising inert gas, for pressurizing said intermediate chamber, a second pressurizing means, comprising inert gas, for pressurizing said dispensing chamber, a first valve configured to permit said liquid material to be admitted into said intermediate chamber from said reservoir, a second valve configured to permit said liquid material to be admitted into said dispensing chamber from said intermediate chamber, and a duct extending from within said dispensing chamber whereby said liquid material can be dispensed through said duct from said dispensing chamber by pressurization of said dispensing chamber.

11. The apparatus of claim 10, wherein at least said intermediate chamber and said dispensing chamber are made from a refractory material selected from the group consisting of clay/graphite refractory materials and clay/silicon carbide refractory materials.

12. The apparatus of claim 10, wherein at least said intermediate chamber and said dispensing chamber are made from a material selected from the group consisting of iron, mild steel and ferrite stainless steel.

13. The apparatus of claim 10, wherein said inert gas is selected from the group consisting of air and carbon dioxide.

14. The apparatus of claim 13, wherein said inert gas is mixed with up to about 2% by volume of sulphur hexafluoride.

15. A method of dispensing liquid material into a mould by means of the apparatus of claim 10, wherein said method comprises a repeated cycle of operations comprising:

(i) pressurizing said dispensing chamber containing said liquid material to cause said liquid material to be discharged through said duct from said chamber and into said mould;

(ii) reducing pressure in said dispensing chamber to lower the level of said liquid material in said duct to a stand-by level;

(iii) pressurizing said intermediate chamber containing said liquid material to transfer said liquid material from said intermediate chamber into said dispensing chamber, thereby recharging said dispensing chamber while maintaining the level of said liquid material in said duct at or about said stand-by level; and (iv) re-charging said intermediate chamber from said reservoir of liquid material, said valve between said intermediate chamber and said dispensing chamber and between said reservoir and said intermediate chamber being opened or closed as required to permit said liquid material to be transferred into and out of said chambers.

* * * * *